US007758382B2

(12) United States Patent
Hiratsuka

(10) Patent No.: US 7,758,382 B2
(45) Date of Patent: Jul. 20, 2010

(54) CONNECTOR WITH ISOLATING END FACE AND SIDE CONNECTIONS AND INFORMATION PROCESSING APPARATUS INCLUDING CONNECTOR

(75) Inventor: Yoshiaki Hiratsuka, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/219,142

(22) Filed: Jul. 16, 2008

(65) Prior Publication Data

US 2009/0061686 A1 Mar. 5, 2009

(30) Foreign Application Priority Data

Aug. 31, 2007 (JP) ..... 2007-226780

(51) Int. Cl.
*H01R 13/648* (2006.01)

(52) U.S. Cl. ..... 439/607.38; 439/607.34; 439/607.41

(58) Field of Classification Search ..... 439/95, 439/607.34–607.4, 607.01–607.26
See application file for complete search history.

(56) References Cited

U.S. PATENT DOCUMENTS

| | | | | |
|---|---|---|---|---|
| 4,738,638 | A * | 4/1988 | Bogese, II | 439/607.43 |
| 4,810,210 | A * | 3/1989 | Komatsu | 439/607.4 |
| 5,011,424 | A | 4/1991 | Simmons | |
| 5,810,620 | A * | 9/1998 | Kobayashi et al. | 392/379 |
| 5,947,773 | A * | 9/1999 | Karam | 439/676 |
| 6,077,120 | A * | 6/2000 | Futatsugi et al. | 439/607.28 |
| 6,129,587 | A * | 10/2000 | Huang | 439/607.38 |
| 6,997,723 | B2 * | 2/2006 | Lee | 439/92 |

FOREIGN PATENT DOCUMENTS

| | | |
|---|---|---|
| CN | 2624447 | 7/2004 |
| JP | 3-35673 | 4/1991 |
| JP | 3-155076 | 7/1991 |
| JP | 4-10979 | 1/1992 |

OTHER PUBLICATIONS

Office Action issued Apr. 2, 2010 in corresponding Chinese Patent Application No. 200810133957.8.

* cited by examiner

*Primary Examiner*—Michael C Zarroli
(74) *Attorney, Agent, or Firm*—Staas & Halsey LLP

(57) ABSTRACT

The present invention provides a connector in which countermeasures against external noise and radiation noise are taken, and an information processing apparatus having such a connector, which suppresses both the external noise and radiation noise. The connector is disposed at an opening formed in an outer face of an information processing apparatus such that the connector does not project from the outer face, a shield cable being connected to the connector from the opening. An end face on the side of the opening is made of an insulative material. The connector includes a signal terminal which connects a signal line of the shield cable and a processing circuit of the information processing apparatus with each other and which is provided at a location other than the end face, and a shield conductor which connects a shield of the shield cable and a ground of the information processing apparatus with each other and which is provided at a location other than the end face.

8 Claims, 6 Drawing Sheets

CONNECTOR WITH ISOLATING END FACE AND SIDE CONNECTIONS AND INFORMATION PROCESSING APPARATUS INCLUDING CONNECTOR

BACKGROUND OF THE INVENTION

1. Field of Invention

The present invention relates to a connector to which a signal cable is connected, and to an information processing apparatus.

2. Description of Related Art

In recent years, high performance and high-speed computation processing of a personal computer have been realized, and thus the personal computer has made a dramatic leap forward.

On the other hand, there is a problem of the temperature increase of a semiconductor device which carries out information processing in the personal computer due to the increase of amount of generated heat. As a method for suppressing the temperature rise of the semiconductor device, a cooling unit is mounted to cool the semiconductor device, and driving voltage is reduced to suppress the amount of generated heat by the semiconductor device per se which generates heat, thereby suppressing the temperature rise. Recently, it is also required to save energy, and there is a tendency that the driving voltage of the semiconductor device is further lowered.

However, if the driving voltage of the semiconductor device is lowered, malfunction is naturally prone to be generated against external noise. There are various factors causing the external noise, and as one of typical external noises, static electricity noise generated when a human body becomes charged is known. A human body or clothes come into contact with the personal computer when the computer is used or moved. Therefore, electric charge which has been accumulated as static electricity in the human body is discharged to generate static electricity noise, and the noise enters the device, so that voltage can not be supplied to the semiconductor device stably, leading to malfunction.

Especially in recent years, it is strongly required to reduce radiation noise which is radiated from the personal computer itself or a cable connected to the personal computer to outside. For this reason, in many cases, a shield cable which is shielded against the radiation noise is used as a cable connected to the personal computer (see Japanese Patent Application Laid-Open (JP-A) No. 3-155076 and Japanese Utility Model Application Laid-Open (JP-U) Nos. 3-035673 and 4-010979, for example). A connector is mounted on a side of the personal computer to which the shield cable is connected. Generally, the connector is covered with a conductive material (e.g., a metal plate) which is electrically connected to the shield for suppressing radiation noise.

However, if a connector having a structure in which its face is covered with the conductive material is mounted in the personal computer, static electricity charged in a human body or the like is prone to be discharged to the conductive material of the connector, and static electricity noise enters the device, thereby causing malfunction. That is, according to the conventional technique, if attempt is made to reduce the radiation noise, the personal computer becomes weaker against the external noise.

Such a problem of the conventional technique generally occurs not only in a personal computer but also in an information processing apparatus having a processing circuit which processes information.

SUMMARY OF THE INVENTION

The present invention has been made in view of the above circumstances and an object of the invention is to provide a connector which takes countermeasures against both external noise and radiation noise, and an information processing apparatus having such a connector, in which both the external noise and radiation noise are suppressed.

To achieve the above object, the present invention provides a connector which is disposed at an opening formed in an outer face of an information processing apparatus such that the connector does not project from the outer face, a shield cable being connected to the connector from the opening, the connector including:

an end face on the side of the opening which end face is made of an insulative material;

a signal terminal which connects a signal line of the shield cable and a processing circuit of the information processing apparatus with each other, the signal terminal being provided at a location other than the end face; and a shield conductor which connects a shield of the shield cable and a ground of the information processing apparatus with each other, the shield connector being provided at a location other than the end face.

According to the connector of the present invention, the end face, which may adversely be exposed to the outer face when the connector is disposed in the information processing apparatus, is made of an insulative material. Thus, even when a user's finger or the like comes into contact from the outer face, discharge is prevented by the insulative material. Accordingly, the static electricity noise from being generated is suppressed. That is, the connector is tolerant to the external noise. Further, since the shield of the shield cable provided with the shield conductor and the ground of the information processing apparatus are connected to each other, radiation noise radiated from the information processing apparatus or the cable can be prevented from being generated. That is, according to the connector of the invention, both the external noise and radiation noise are suppressed.

The connector of the present invention is preferably configured such that a portion of a side face connected to the end face along the end face is also made of an insulative material. Since the portion extending along the end face is also made of an insulative material, the discharge of static electricity is further suppressed, to thereby further suppressing generation of static electricity noise.

It is preferable that at least 2.7 mm or more of a portion of a side face connected to the end face along the end face as measured from the end face is also made of an insulative material. As 2.7 mm or more of the portion extending along the end face is an insulative material, it is possible to reliably prevent the breakdown caused by static electricity, and also to reliably prevent static electricity noise from being generated.

Preferably, the connector of the present invention further includes an inner wall constituting an inner space in which the shield cable is inserted, and the shield conductor is a metal member having a first portion which exists on an outer face of the connector except the end face and which is connected to the ground, and a second portion which exists on the inner wall and which is connected to the shield, the metal member passing through between the outer face and the inner wall.

The connector having the metal member as the shield conductor is preferable because the shield conductor can easily be disposed.

More preferably, the first portion of the shield conductor surrounds the connector except the end face of the connector.

This is because, when the first portion surrounds the connector, the shield conductor and the connector are united together.

To achieve the above object, the present invention provides an information processing apparatus including:

an outer face formed with an opening;

a processing circuit provided in the information processing apparatus for processing information;

a ground provided in the information processing apparatus; and a connector which is disposed at the opening such that the connector does not project from the outer face, a shield cable being connected to the connector from the opening, the connector including:

an end face on the side of the opening which end face is made of an insulative material;

a signal terminal which connects a signal line of the shield cable and a processing circuit with each other, the signal terminal being provided at a location other than the end face; and a shield conductor which connects a shield of the shield cable and the ground with each other, the shield conductor being provided at a location other than the end face.

Since the information processing apparatus of the invention has the connector of the invention, it is possible to prevent external noise from entering from the connector, and radiation noise radiated from the information processing apparatus is also prevented.

In the information processing apparatus of the invention, it is preferable that a portion of a side face connected to the end face along the end face is also made of insulative material. Since the portion extending along the end face is also made of an insulative material, the discharge of static electricity is further suppressed and generation of static electricity noise is further suppressed.

Preferably, at least 2.7 mm or more of a portion of a side face connected to the end face along the end face as measured from the end face is also made of an insulative material. As 2.7 mm or more of the portion extending along the end face is an insulative material, it is possible to reliably prevent the breakdown caused by static electricity, and also to reliably prevent static electricity noise from being generated.

Also preferably, the information processing apparatus further includes an inner wall constituting an inner space in which the shield cable is inserted, and the shield conductor is a metal member having a first portion which exists on an outer face of the connector except the end face and which is connected to the ground, and a second portion which exists on the inner wall and which is connected to the shield, the metal member passing through between the outer face and the inner wall.

The connector having the metal member as the shield conductor is preferable because the shield conductor can easily be disposed.

More preferably, the first portion of the shield conductor surrounds the connector except the end face of the connector.

This is because, when the first portion surrounds the connector, the shield conductor and the connector are integrally formed together.

As explained above, according to the connector and the information processing apparatus of the present invention, both the external noise and radiation noise are suppressed.

DETAILED DESCRIPTION OF THE INVENTION

Embodiments of the present invention will be explained with reference to the drawings.

Figure 1:
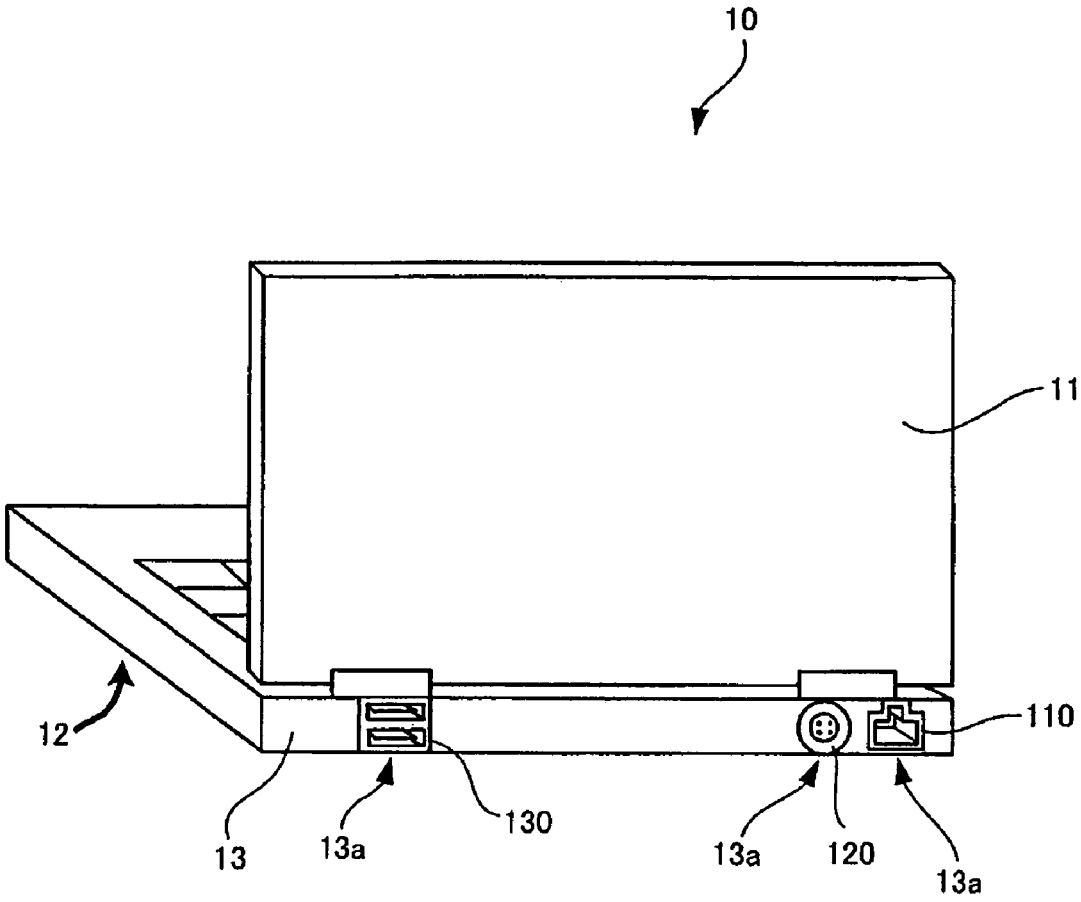
FIG. 1 is a diagram showing a notebook personal computer corresponding to an embodiment of an information processing apparatus of the present invention.

FIG. 1 is a diagram showing a notebook personal computer corresponding to an embodiment of an information processing apparatus of the present invention.

FIG. 1 shows aback face of the notebook personal computer 10. The personal computer 10 includes a lid 11 and a main body 12. The lid 11 can open and close with respect to the main body 12. A display is provided on an inner side (hidden side in FIG. 1) of the lid 11.

A CPU which carries out computation processing and the like are incorporated in the main body 12. Multiple openings 13*a* are formed in a casing 13 on the side of the back face of the main body 12. A LAN connector 110, an S-OUT connector 120 and a USB connector 130 are provided at the openings 13*a*. Each of the LAN connector 110, the S-OUT connector 120 and the USB connector 130 is an embodiment of the connector of the invention, and shield cables are inserted from the openings 13*a* to be connected.

The LAN connector 110 will be described in detail as a representative of the LAN connector 110, the S-OUT connector 120 and the USB connector 130.

Figure 2:
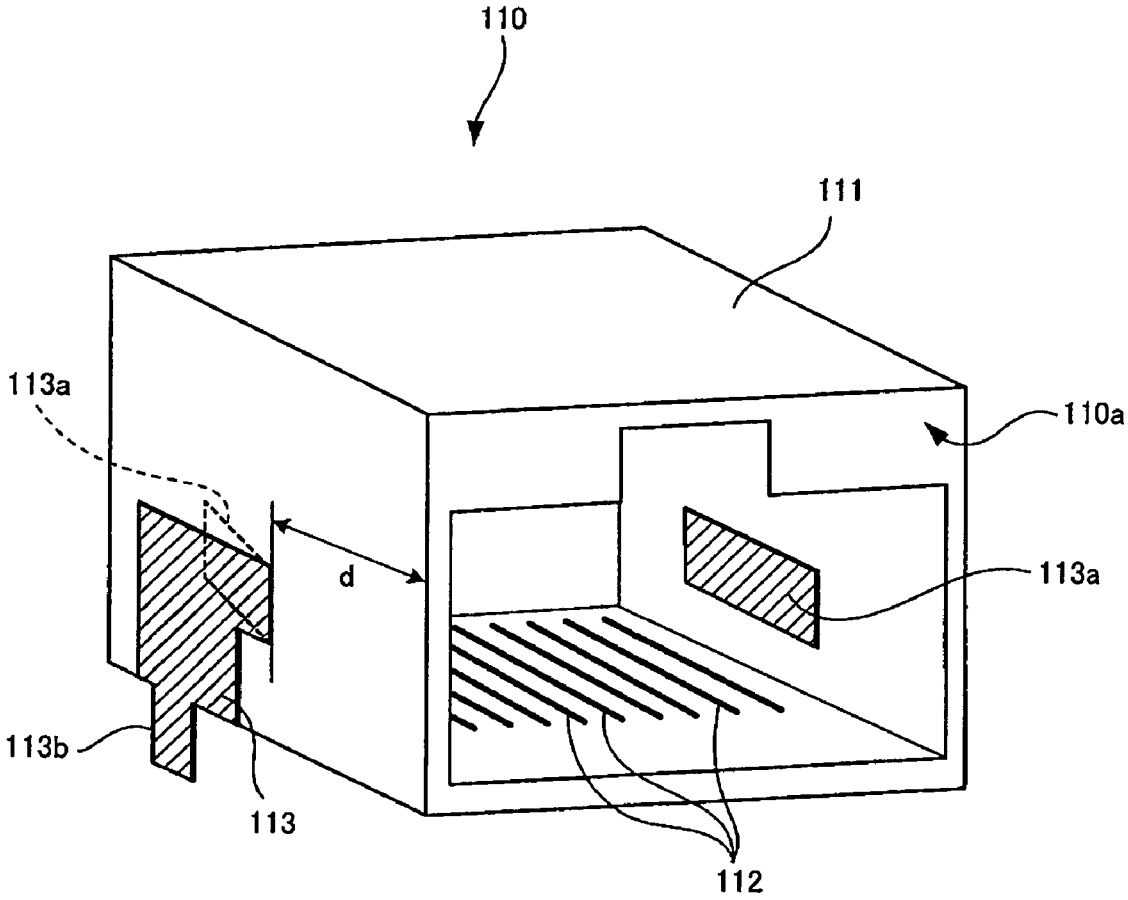
FIG. 2 is a diagram showing a structure of a LAN connector shown in FIG. 1.

FIG. 2 is a diagram showing a structure of the LAN connector 110 shown in FIG. 1.

The LAN connector 110 shown in FIG. 2 includes a box-like plastic main body 111, plural signal terminals 112 provided on an inner wall of the main body 111, and a metal member 113 passing from an outer face to the inner wall of the main body 111. Since the opening of the box-like main body 111 is small, a user's finger does not reach the inner wall of the main body 111.

The signal terminals 112 are connected through a bus to, for example, the CPU incorporated in the main body 12 of the personal computer 10 shown in FIG. 1.

An inner side of the main body 111 of the metal member 113 which passes through the main body 111 is a shield terminal 113*a* which is connected to the shield of the shield cable. An outer side of the main body 111 of the metal member 113 is connected through a fixing terminal 113*b* to a ground of the personal computer shown in FIG. 1.

As shown in FIG. 2, the plastic main body 111 which is an insulative material is exposed from an end (front side end in FIG. 2) 110*a* of the LAN connector 110 on the side where the cable is connected, and no conductor exists at the end. Therefore, if it is disposed in the personal computer 10 is disposed as shown in FIG. 1, only the insulative material (here, plastic) is exposed directly inside the opening 13*a* of the casing 13. The metal member 113 is disposed at a later-described distance d from the end 110*a* of the LAN connector 110.

Effect of noise countermeasure in this embodiment will be explained. Before the effect is explained, a comparative example having the conventional connector structure and the principle of external noise generation will be explained first and then, the effect of noise countermeasure in this embodiment will be explained.

Figure 3:
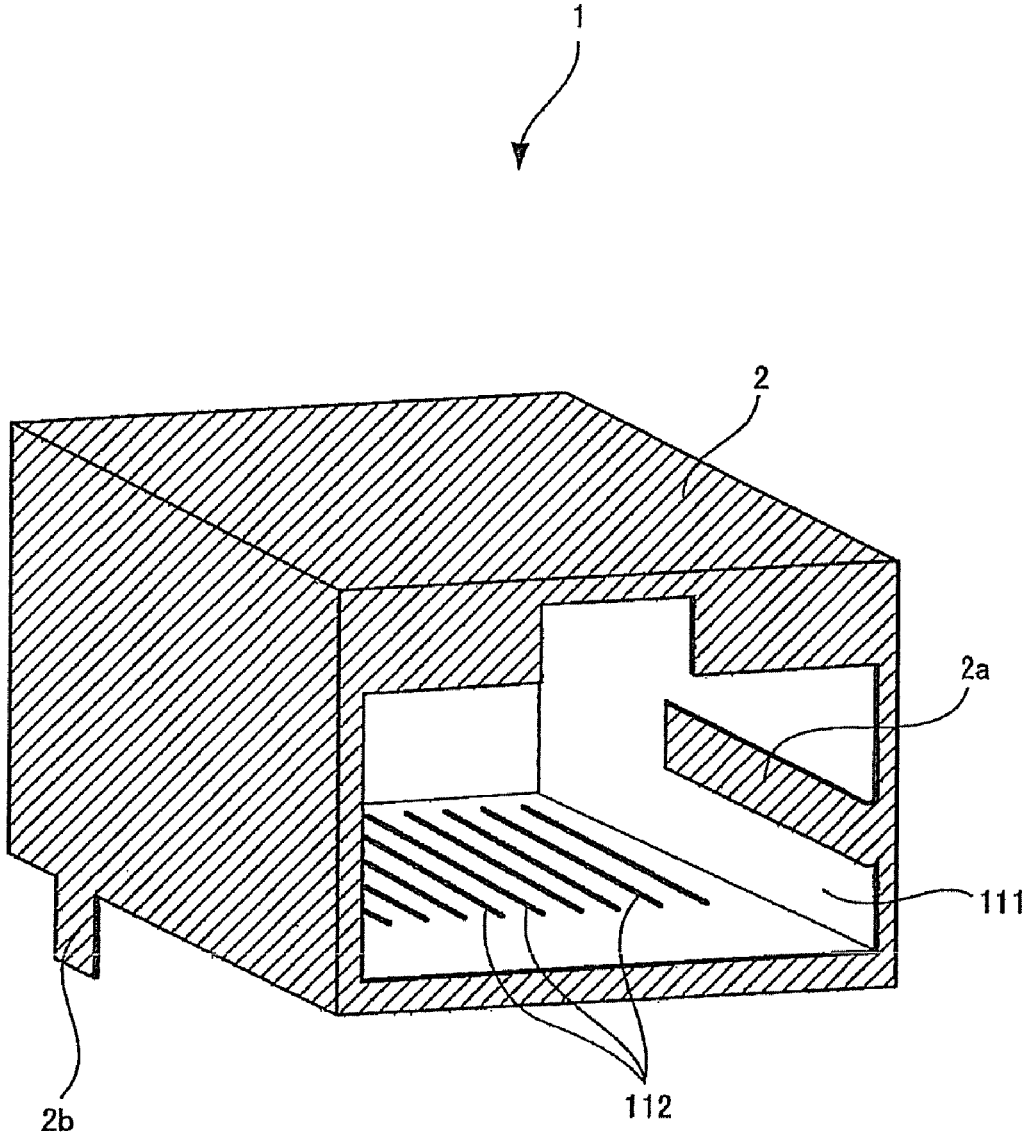
Fig. 3 PRIOR ART
FIG. 3 is a diagram showing a structure of a comparative example.

FIG. 3 is a diagram showing a structure of the comparative example. Although FIG. 3 does not show the above-described embodiment, the same elements as those shown in FIG. 2 are designated with the same symbols also in FIG. 3, and the redundant explanation will be omitted.

According to a LAN connector 1 of the comparative example having the conventional connector structure, the entire outer face of a box-like main body 111 including an end thereof to which a cable is connected is covered with a metal plate 2, and signal terminals 112 is provided on a bottom of an inner wall of the main body 111. A portion of the metal plate 2 covering the entire outer face of the main body 111 is bend inward of the main body 111 to form a shield terminal 2*a* to be connected to a shield of the connector. The metal plate 2 is connected through a fixing terminal 2*b* to a ground of the personal computer 10 shown in FIG. 1.

Figure 4:
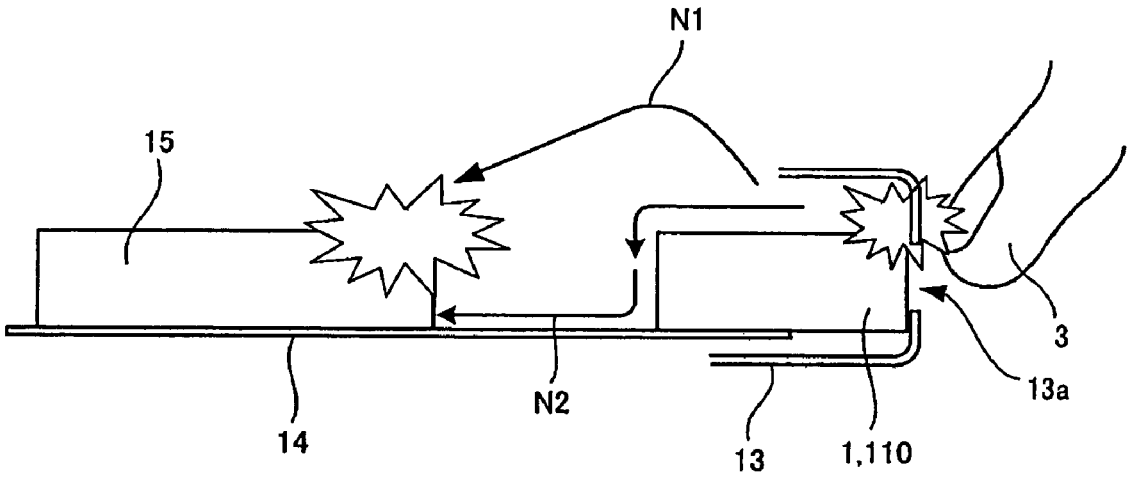
FIG. 4 is a diagram explaining the principle of external noise generation.

FIG. 4 is an explanatory diagram of the principle of external noise generation.

The LAN connector 110 shown in FIG. 2 is provided in the opening 13*a* of the casing 13 of the personal computer as described above. For example, a CPU 15 which carries out computation processing is provided in the casing 13. A printed board 14 on which the LAN connector 110 and the CPU 15, etc. are mounted is also provided in the casing 13. A ground is provided on the printed board 14, the LAN connector 110 is fixed to the printed board 14 by the fixing terminal 113*b* shown in FIG. 2, and is connected to the ground through the fixing terminal 113*b*.

Here, it is assumed that the LAN connector 1 of the comparative example shown in FIG. 3 is mounted instead of the LAN connector 110 of the embodiment. This assumed structure is a structure which is conventionally employed. If a user's finger 3 or clothes approach the opening 13*a* of the casing 13, static electricity charged in the user's body or cloths is discharged to the metal plate 2 shown in FIG. 3, and large current is generated instantaneously. This current flows to the ground of the printed board 14 through the fixing terminal 2*b* of the LAN connector 1, reaches the CPU 15 to become conduction noise N2, causing to malfunction of the CPU 15. When the static electricity is discharged to the metal plate 2, radiation noise N1 radiated in the air is generated as an electromagnetic wave, and this radiation noise N1 also reaches the CPU 15 to cause malfunction.

Sufficient countermeasures against the external noise generated based on the principle of generation are taken in the personal computer 10 shown in FIG. 1 and the LAN connector 110 shown in FIG. 2. The countermeasures will be explained with reference to FIG. 2.

As described above, an end 110*a* of the LAN connector 110 on the side to which the cable is connected is insulative. Thus, even if the LAN connector 110 is disposed at the opening 13*a* of the casing 13 and the user's finger 3 approaches the LAN connector 110 as shown in FIG. 4, discharge phenomenon is suppressed since a conductive object to which static electricity is discharged is not exposed. The metal member 113 shown in FIG. 2 is disposed on the LAN connector 110 at a distanced from the end 110*a* as described above. The distance d is set to 2.7 [mm] or higher such as to satisfy:

$$\text{distance } d \geqq 2.6667 \text{ [mm]}$$

which is a result obtained by substituting general breakdown electrolytic strength in the air: $3\times10^6$ [V/m] and static electricity voltage specified by the international specification CISPR 24: $8\times10^3$ [v] into a relation formula: distance d≧interelectrode voltage [V]/breakdown electric field strength [V/m], for calculating the distance allowing prevention of breakdown. Therefore, in the LAN connector 110 of the embodiment, even if the user's finger comes into contact with the LAN connector 110 from the opening 13*a* shown in FIG. 1, static electricity is not discharged and static electricity noise is prevented.

The metal member 113 which is disposed in this manner electrically connects the shield of the shield cable to be connected to the LAN connector 110 and the ground in the personal computer with each other, thereby suppressing radiation noise which is radiated to outside from the personal computer itself or the cable connected to the personal computer.

The metal member 113 employed in the LAN connector 110 of this embodiment is different from the metal plate 2 used in the conventional LAN connector 1 shown in FIG. 3, and the metal member 113 covers only a portion of the plastic main body 111. Suppression of radiation noise by the metal member 113 which covers only a portion of the main body 111 will be verified below.

Figure 5:
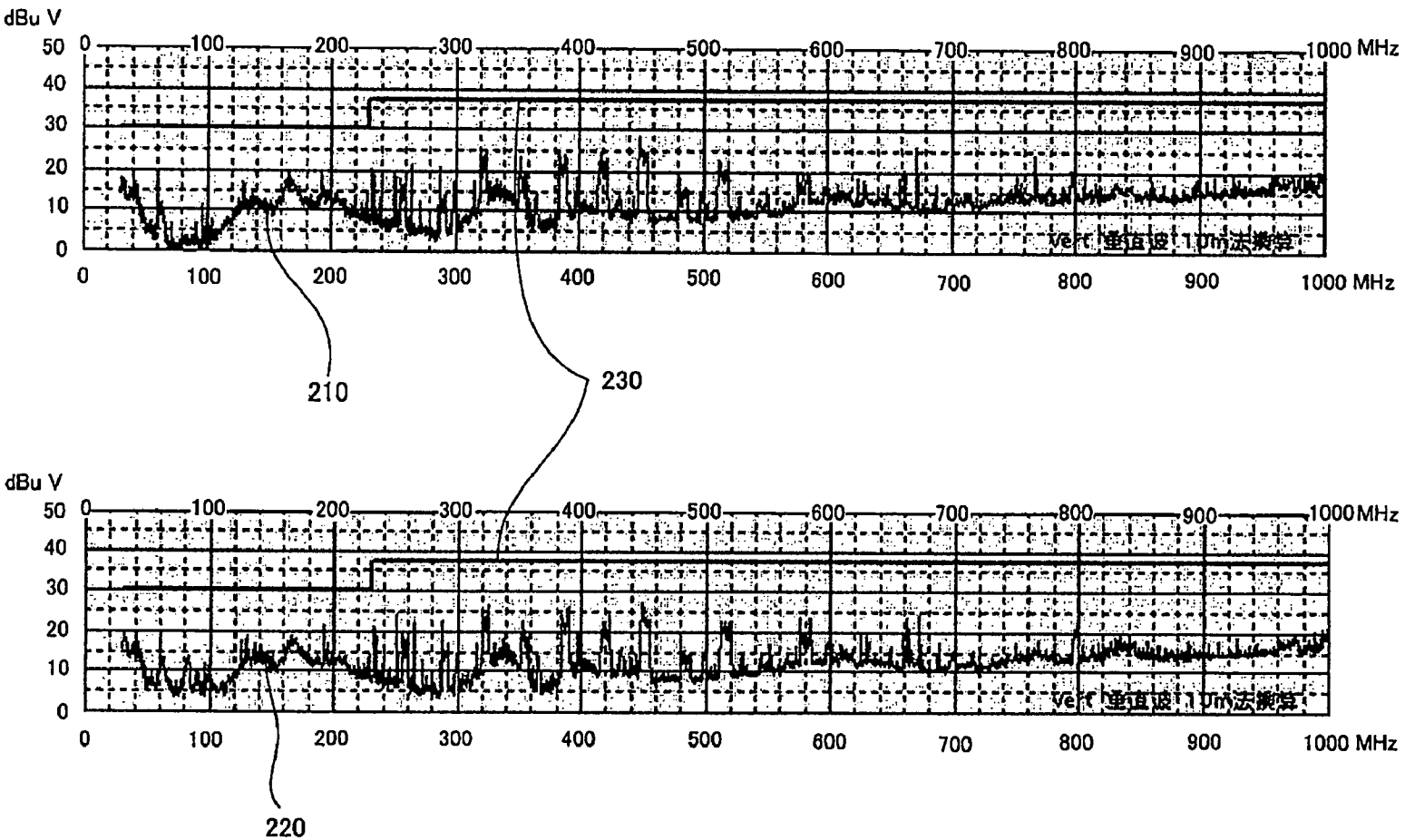
FIG. 5 is a graph showing verification results of the ability of suppressing radiation noise in the LAN connector of the embodiment.

FIG. 5 is a graph showing verification results of ability of suppressing radiation noise in the LAN connector 110 of the embodiment.

The lateral axes in FIG. 5 show frequency of the radiation noise, and the vertical axes show output level of the radiation noise.

FIG. 5 shows measurement results of the radiation noise in upper and lower halves. The upper measurement result 210 is a measurement result when the conventional LAN connector 1 shown in FIG. 3 is mounted, and the lower measurement result 220 is a measurement result when the LAN connector 110 of the embodiment shown in FIG. 2 is mounted.

Suppression target values 230 of the radiation noise are also shown together with the measurement results. If the measurement results 210 and 220 of radiation noise are lower than the suppression target value 230, this means that the radiation noise suppression ability is sufficient.

When the two measurement results 210 and 220 shown in FIG. 5 are compared, it has been found even if the LAN connector 110 of the embodiment having the metal member of a small area is used, the radiation noise level is quite the same as that of the conventional technique. That is, when the shield of the shield cable and the ground in the personal computer are electrically connected to each other, this suppresses the radiation noise, and it is unnecessary to cover the surrounding of the LAN connector with the metal plate.

As explained above, when the personal computer 10 shown in FIG. 1 has the LAN connector 110 of the embodiment, the personal computer 10 is tolerant to the external noise (especially static electricity noise) and radiation noise is also low. The LAN connector 110 has been explained as a representative. Similarly to the LAN connector 110, end faces of the S-OUT connector 120 and the USB connector 130 shown in FIG. 1 which face the openings 13*a* of the casing 13 are also made of an insulative material, and conductive members which connect the shield of the shield cable and the ground in the personal computer are provided in portions of the S-OUT connector 120 and the USB connector 130 other than the end faces.

Next, a LAN connector of another embodiment different from the LAN connector 110 shown in FIG. 2 will be explained. The LAN connector of this another embodiment can be disposed in the personal computer shown in FIG. 1 instead of the LAN connector 110 shown in FIG. 2. In the following explanation, the same elements as those of the LAN connector 110 shown in FIG. 2 are designated with the same symbols shown in FIG. 2, and the redundant explanation will be omitted.

Figure 6:
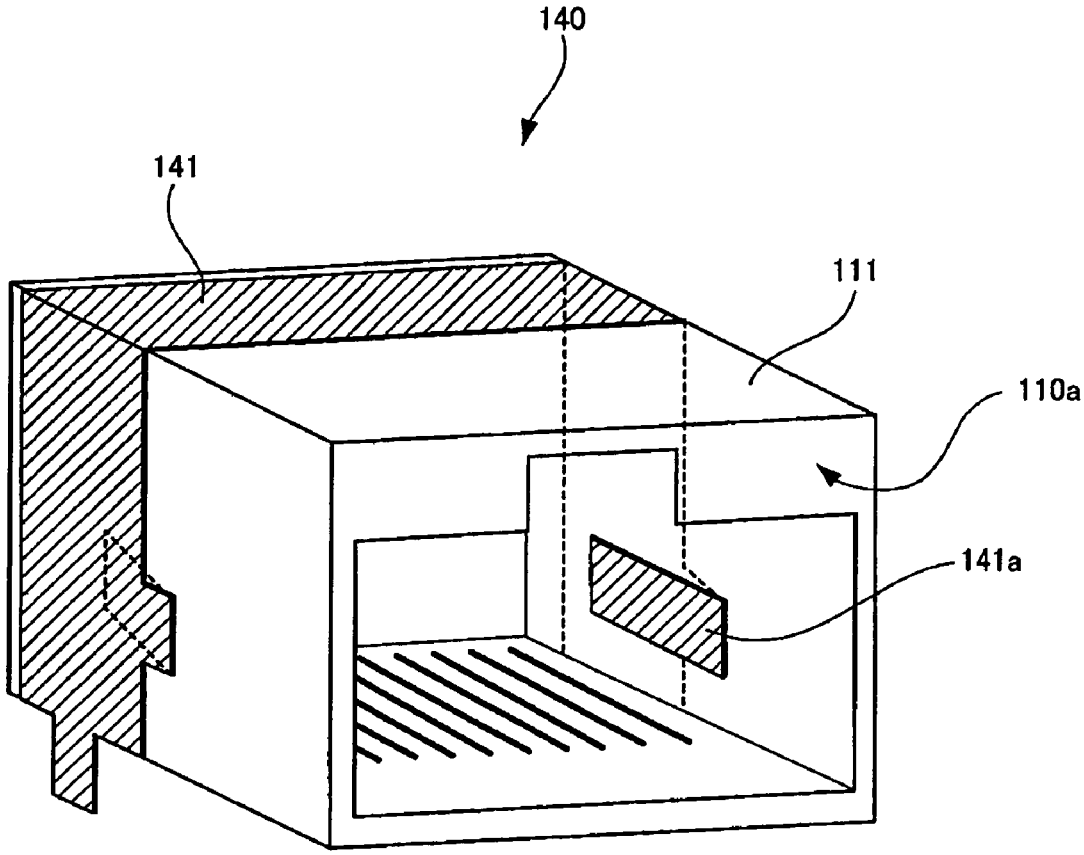
FIG. 6 is a diagram showing a structure of the LAN connector according to another embodiment.

FIG. 6 is a diagram showing a structure the LAN connector according to the another embodiment.

According to the LAN connector 140 shown in FIG. 6, a metal member 141 is provided such as to surround the main body 111. The metal member 141 is naturally separated away by a sufficient distance from an end 110*a* on the side where the cable is connected. One end 141*a* of the metal member 141 passes through a wall of the box-like main body 111 to project inward, and is connected to the shield of the shield cable connected to the LAN connector 140.

The LAN connector 140 of the embodiment shown in FIG. 6 has an excellent fit between the metal member 141 and the main body 111 and has high durability as the connector.

Although the notebook personal computer is shown as the embodiment of the information processing apparatus of the present invention in the above explanation, the information processing apparatus of the invention may be various kinds of information processing apparatuses such as a desktop personal computer and a communication apparatus.

Although the connector of the invention is connected to the ground in the above explanation, the connector of the invention may be connected to a frame ground provided in a casing of the computer.

Although the connector having the main body made of plastic is shown as the embodiment of the connector of the present invention in the above explanation, the main body of the connector of the invention may be made of ceramic, or thermosetting resin.

Although the connector of the structure in which the metal member is mounted on the main body made of an insulative material is shown as the embodiment of the connector of the present invention in the above explanation, plastic or ceramic which becomes an end face of the connector may be mounted on the conductive main body.

What is claimed is:

1. A connector disposed in an information processing apparatus, with an opening formed in an outer face of the information processing apparatus, said connector comprising:

a body located inside the information processing apparatus, including:

a cable entry side having an opening aligned with the opening formed in the outer face of the information processing apparatus, whereby a shield cable may be inserted through the opening in the cable entry side and connected to the connector;

an end face opposite the cable entry side, which end face is made of an insulative material; and an inner wall surrounding an inner space into which the shield cable is inserted;

a signal terminal which connects a signal line of the shield cable and a processing circuit of the information processing apparatus with each other, the signal terminal being provided at a location other than the end face; and a shield conductor made of metal, passing through the body, and having a first portion, which connects to a shield of the shield cable inside the body, and a second portion which connects to a ground of the information processing apparatus outside the body, the shield connector being provided at a location other than the end face.

2. The connector according to claim 1, wherein a portion of the inner wall, which is connected to the end face along the end face, is also made of an insulative material.

3. The connector according to claim 1, wherein at least 2.7 mm or more of a portion of the inner wall, which is connected to the end face along the end face as measured from the end face, is also made of an insulative material.

4. The connector according to claim 1, wherein the second portion of the shield conductor surrounds the body except the end face.

5. An information processing apparatus, comprising:

an outer face formed with an opening;

a processing circuit provided in the information processing apparatus for processing information;

a ground provided in the information processing apparatus; and a connector which is disposed at the opening, inside the information processing apparatus, a shield cable being connected to the connector through the opening, the connector including:

a body having:

a cable entry side having an opening aligned with the opening formed in the outer face of the information processing apparatus;

an end face opposite the cable entry side, which end face is made of an insulative material; and an inner wall surrounding an inner space in which the shield cable is inserted;

a signal terminal which connects a signal line of the shield cable and the processing circuit with each other, the signal terminal being provided at a location other than the end face; and a shield conductor made of metal, passing though the body, and having a first portion, which connects to a shield of the shield cable inside the body, and a second portion, which connects to the ground outside the body, the shield conductor being provided at a location other than the end face.

6. The information processing apparatus according to claim 5, wherein a portion of the inner wall of the connector, which is connected to the end face along the end face, is also made of an insulative material.

7. The information processing apparatus according to claim 5, wherein at least 2.7 mm or more of a portion of the inner wall of the connector, which is connected to the end face along the end face as measured from the end face, is also made of an insulative material.

8. The information processing apparatus according to claim 5, wherein the second portion of the shield conductor surrounds the body except the end face.

* * * * *

UNITED STATES PATENT AND TRADEMARK OFFICE

CERTIFICATE OF CORRECTION

PATENT NO. : 7,758,382 B2
APPLICATION NO. : 12/219142
DATED : July 20, 2010
INVENTOR(S) : Yoshiaki Hiratsuka It is certified that error appears in the above-identified patent and that said Letters Patent is hereby corrected as shown below:

Column 8, Line 44 delete “though” and insert -- through --, therefor.

Signed and Sealed this
Fourth Day of January, 2011

David J. Kappos

David J. Kappos
*Director of the United States Patent and Trademark Office*